US009151475B2

(12) United States Patent
Huang et al.

(10) Patent No.: US 9,151,475 B2
(45) Date of Patent: Oct. 6, 2015

(54) LED TUBE LIGHT

(71) Applicant: LITE-ON TECHNOLOGY CORPORATION, Taipei (TW)

(72) Inventors: Jen-Min Huang, Hsinchu (TW); Shu-Hua Yang, Taichung (TW); Chih-Lung Liang, Taipei (TW)

(73) Assignee: LITE-ON TECHNOLOGY CORPORATION, Taipei (TW)

( * ) Notice: Subject to any disclaimer, the term of this patent is extended or adjusted under 35 U.S.C. 154(b) by 356 days.

(21) Appl. No.: 13/727,729

(22) Filed: Dec. 27, 2012

(65) Prior Publication Data

US 2013/0170196 A1 Jul. 4, 2013

Related U.S. Application Data

(60) Provisional application No. 61/582,448, filed on Jan. 2, 2012.

(51) Int. Cl.

| | |
|---|---|
| ***F21V 21/00*** | (2006.01) |
| ***F21S 4/00*** | (2006.01) |
| ***F21V 7/20*** | (2006.01) |
| ***F21V 29/00*** | (2015.01) |
| ***F21V 23/00*** | (2015.01) |
| ***F21K 99/00*** | (2010.01) |
| ***F21V 3/04*** | (2006.01) |
| ***F21V 29/506*** | (2015.01) |
| *F21Y 101/02* | (2006.01) |
| *F21V 17/10* | (2006.01) |
| *F21V 19/00* | (2006.01) |
| *F21V 29/87* | (2015.01) |
| *F21V 29/89* | (2015.01) |

(52) U.S. Cl.

CPC . *F21V 21/00* (2013.01); *F21K 9/17* (2013.01); *F21V 3/0418* (2013.01); *F21V 23/00* (2013.01); *F21V 29/506* (2015.01); *F21V 17/101* (2013.01); *F21V 19/003* (2013.01); *F21V 23/005* (2013.01); *F21V 29/87* (2015.01); *F21V 29/89* (2015.01); *F21Y 2101/02* (2013.01)

(58) Field of Classification Search

CPC ..... F21K 9/10; F21K 9/17; F21K 9/175; F21V 3/0418; F21V 3/0427; F21V 3/0409; F21V 19/003; F21V 19/005; F21V 19/0055; F21V 19/0035; F21V 19/0025; F21V 1/20; F21V 17/12; F21S 4/008

USPC ..... 362/225, 223, 217.13, 217.14, 217.15, 362/217.16, 217.17, 218, 219

See application file for complete search history.

(56) References Cited

U.S. PATENT DOCUMENTS

| | | | | |
|---|---|---|---|---|
| 2009/0147498 | A1* | 6/2009 | Park | 362/84 |
| 2009/0290334 | A1* | 11/2009 | Ivey et al. | 362/219 |
| 2011/0228517 | A1* | 9/2011 | Kawabat et al. | 362/84 |
| 2012/0182728 | A1* | 7/2012 | Watanabe | 362/218 |
| 2012/0212951 | A1* | 8/2012 | Lai et al. | 362/218 |

FOREIGN PATENT DOCUMENTS

| | | |
|---|---|---|
| JP | 2010-244872 | 10/2010 |
| JP | 2011-070988 | 4/2011 |
| JP | 2011-138681 | 7/2011 |

* cited by examiner

*Primary Examiner* — Hargobind S Sawhney
*Assistant Examiner* — William N Harris
(74) *Attorney, Agent, or Firm* — Li & Cai Intellectual Property (USA) Office

(57) ABSTRACT

An LED tube light includes a glass tube, a base, a light emitting unit, and two lateral cover assemblies. The base has a length larger than the length of the glass tube, wherein two opposite end portions of the base are arranged out of a region defined by orthographically projecting from the glass tube to the base. The light emitting unit is fixed on the base and is used for emitting light, passing through the glass tube to illuminate. The two lateral cover assemblies are respectively covered around the two end portions of the glass tube, wherein the two lateral cover assemblies are respectively installed on the two end portions of the base for maintaining the relative position between the cover assemblies and the base.

14 Claims, 15 Drawing Sheets

2
21
23
22
231
222
221
211

5
51
7
52
C
1
12
R
11
H1
H2
3112
312
311
3
31
32
33
34
3111
P
511
53
521
5111
6

LED TUBE LIGHT

BACKGROUND OF THE INVENTION

1. Field of the Invention

The invention relates to an elongated shape LED tube; more particularly, to an LED glass tube light.

2. Description of Related Art

In general, an LED glass tube light is easily broken or damage due to non-uniform external force (such as the rotation of the torque or gravity) concentrated on glass tube.

To achieve the abovementioned improvement, the inventors strive via industrial experience and academic research to present the invention, which can provide additional improvement as mentioned above.

SUMMARY OF THE INVENTION

One embodiment of the invention provides an LED tube light having better structural durability and lower breakage probability.

The LED tube light is assembled by a glass tube, a base, a light emitting unit, and two lateral cover assemblies. The base has a length larger than the length of the glass tube. The two lateral cover assemblies are respectively covered around the two end portions of the glass tube are respectively installed on the two end portions of the base for maintaining the relative position between the cover assemblies and the base.

Preferably, the glass tube is adhered to the base by a glue for maintaining the relative position between the cover assemblies and the base.

Preferably, each lateral cover assembly has a first cover, a second cover installed on the first cover. Each one of the first and second covers has a buffering segment, and each buffer is disposed on the buffering segments of each the installed first and second covers. The two end portions of the glass tube are respectively disposed in the buffering segments of the two lateral cover assemblies, and the outer surface of the two end portions of the glass tube are respectively abutted on the buffers of the two lateral cover assemblies.

Base on the above, when the lateral cover assemblies is loaded a force, the force is transferred to the base and then uniformly dispersed to the glass tube by installing the lateral cover assemblies on the base, so that the reliability of the glass tube is improved and the broken probability of the glass tube is reduced.

In order to further appreciate the characteristics and technical contents of the invention, references are hereunder made to the detailed descriptions and appended drawings in connection with the invention. However, the appended drawings are merely shown for exemplary purposes, rather than being used to restrict the scope of the invention.

DETAILED DESCRIPTION OF THE PREFERRED EMBODIMENTS

Figure 1:
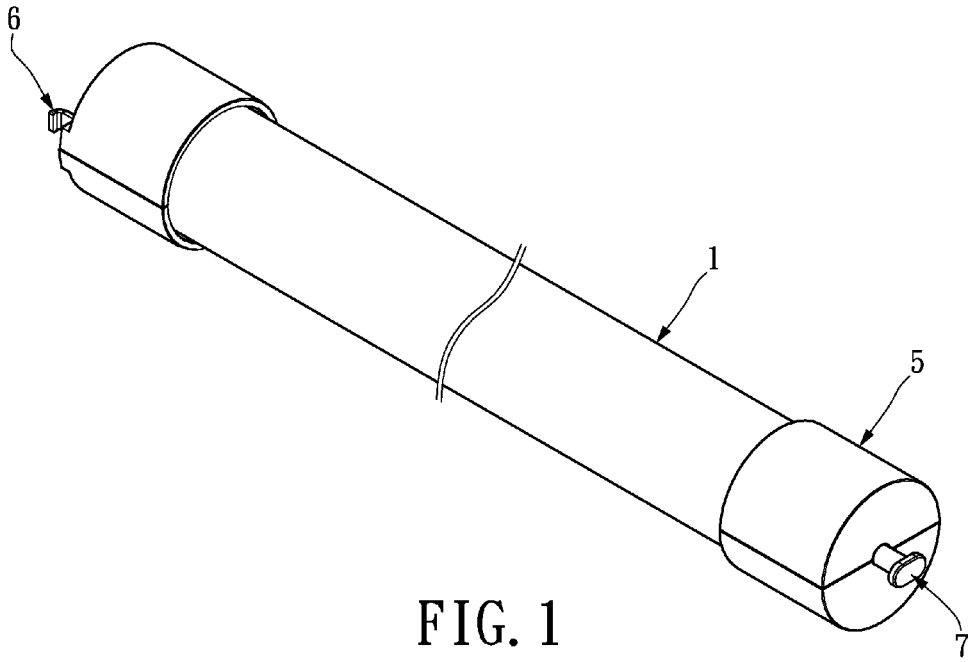
FIG. 1 is a perspective view of an LED tube light of the invention.
Figures 2, 2A, 2B:
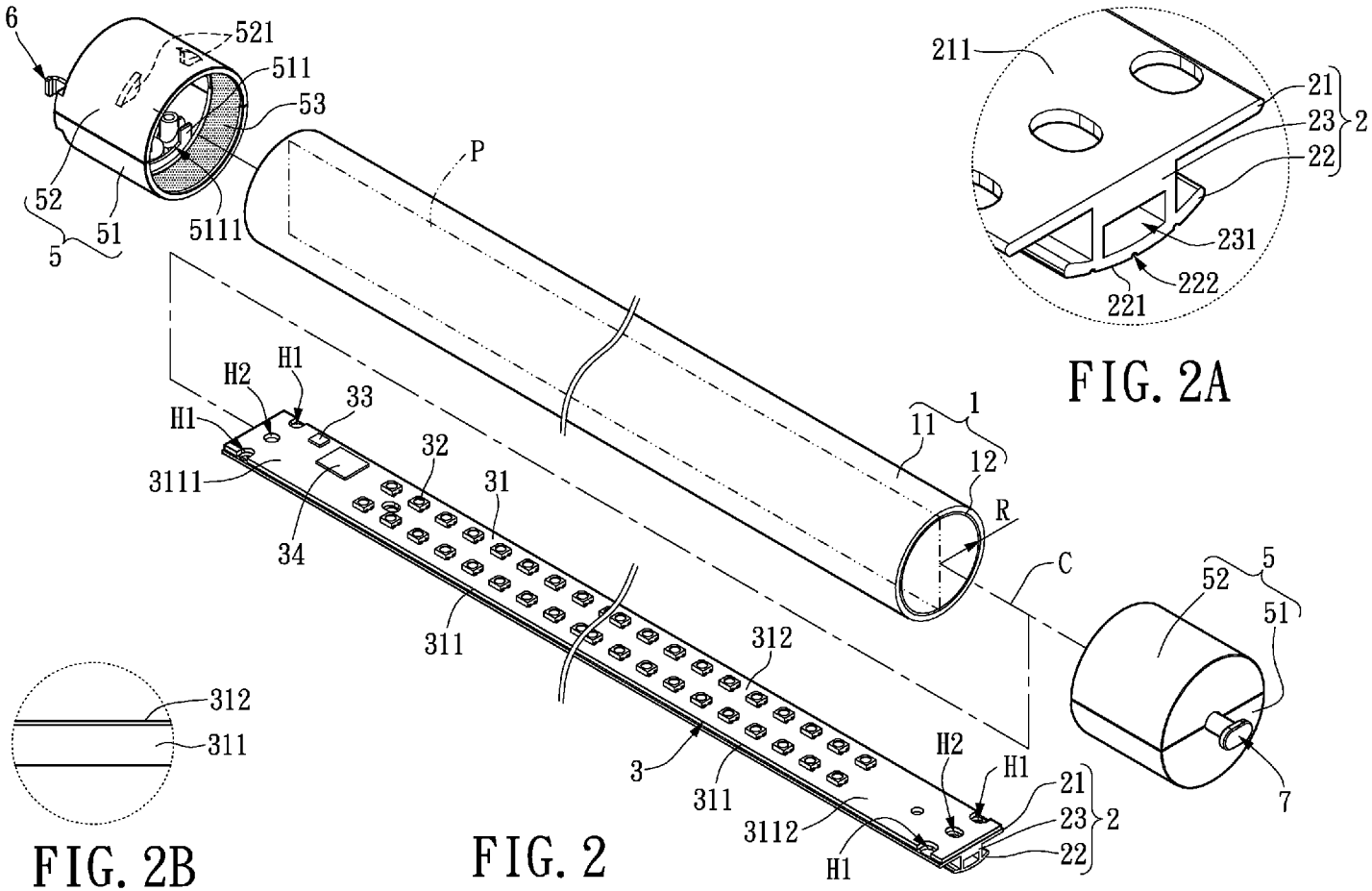
FIG. 2 is an exploded view of the LED tube light of the invention.
FIG. 2A is a partial enlarged view of FIG. 2.
FIG. 2B is another partial enlarged view of FIG. 2.

Please refer to FIGS. 1 and 2, which show a perspective view and an exploded view of an LED tube light conformed to JEL 801 standard. The LED tube light includes a glass tube 1, a base 2, a light emitting unit 3, a glue 4 (e.g., silica gel), two lateral cover assemblies 5, two conductive terminals 6, and a grounding terminal 7.

The glass tube 1 has a hollow cylinder shape. Suitable materials for the glass tube 1 include high borosilicate glass, soda-lime glass, and other transparent materials. The glass tube 1 has a tubular body 11 with a diffusing layer 12 coated on an inner surface of thereof. The glass tube 1 is characterized by a central axis C, a radius R, and a bisecting plane P. In a radial cross-section of the glass tube 1, each distance from the central axis C to any one point of the inner surface of the glass tube 1 is the radius R, i.e., the central axis C is arranged on the bisecting plane P, and the bisecting plane P divides the internal volume of the glass tube 1 into two identical portions.

The base 2 may be made of materials having high thermal conductive efficiency, such as metallic material (e.g., aluminum), ceramic material (e.g., alumina or aluminum nitride), or thermal conductive plastic. The base 2 can be a hollow or a solid structure. The base 2 has an elongated shape corresponding to the glass tube 1. For the ease of referral, the length of the glass tube 1 is denoted as L1, the length of the base is denoted as L2, and the length of each of the later cover assemblies is denoted as L3. The length $L_2$ of the base 2 is larger than the length $L_1$ of the glass tube 1. Specifically, the two opposite end portions of the base 2 are arranged out of a region defined by orthographically projecting from the glass tube 1 to the base 2. The relationship among the length $L_1$ of the glass tube 1, the length $L_2$ of the base 2, and the length $L_5$ of the lateral cover assemblies 5 is: $L_1+\frac{4}{3}L_5 \geq L_2 \geq L_1+\frac{2}{3}L_5$.

The base 2 has a mounting portion 21, a connecting portion 22, and an intermediate portion 23 connecting the mounting portion 21 and the connecting portion 22.

The mounting portion 21 being approximately planar in shape and has a mounting surface 211 away from the connecting portion 22 (as FIG. 2A shown) configured to carry electrical components. The connecting portion 22 has a circular arc surface 221 away from the mounting portion 21. The circular arc surface 221 in this embodiment is approximately corresponding to the inner surface of the glass tube 1, that is to say, the circular arc surface 221 and the corresponding surface of the glass tube 1 are substantially matched. The cross-section of the mounting portion 21, the connecting portion 22, and the intermediate portion 23 are formed as an inverted mound shape, that is to say, the width of the mounting portion 21 is larger than the width of the connecting portion 22, and the area of the circular arc surface 221 is smaller than the area of the mounting surface 211. Moreover, the base 2 has a plurality of grooves 222 concavely formed on the circular arc surface 221 along a direction parallel to the central axis C.

In addition, a preferable relationship between the width of the mounting portion 21 (denoted as $W_{21}$) and the width of the connecting portion 22 (denoted as $W_{22}$) is: $W_{21} \geq W_{22} > \frac{1}{2} W_{21}$ or $\frac{3}{2} W_{22} \geq W_{21} > 2W_{22}$, the width $W_{21}$ of the mounting portion 21 to the width $W_{22}$ of the connecting portion 22 ($W_{21}/W_{22}$) is preferably 9:5. However, actual design parameters and implementation of the invention may depend on practical needs and other specific requirements, and shall not be limited to the example of the instant embodiment.

The two opposite ends of the intermediate portion 23 are respectively connected to the center portion of the mounting portion 21 and the center portion of the connecting portion 22. The intermediate portion 23 has a through hole 231 adjacent to the connecting portion 22, and the through hole 231 is penetrating the intermediate portion 23 along a direction parallel to the central axis C. Thus, the strength of the base 2 is increased for preventing deformation by the above structure design.

The light emitting unit 3 includes a circuit board module 31, a plurality of LEDs 32, a socket connector 33, and an electronic unit 34.

The circuit board module 31 may comprise a plurality of circuit boards 311 (e.g., three circuit boards 311, as a preferable example) arranged in one row and a solder-resistant layer 312. The shape of the circuit boards 311 in a single row is arranged approximately in correspondence to the mounting surface 211 of the base 2.

The LEDs 32 are respectively mounted on a front surface of the circuit boards 311 and electrically connected to the circuit boards 311. The solder-resistant layer 312 is coated on the front surface of the circuit boards 311 for reflecting light. The circuit board module 31 has a conductive segment 3111 and a grounding segment 3112 arranged on opposite sides thereof. The LEDs 32 do not be mounted on the conductive segment 3111 and the grounding segment 3112 in this embodiment.

The socket connector 33 and the electronic unit 34 are mounted on the conductive segment 3111 of the circuit board module 31 and electrically connected to the LEDs 32 by the circuit board module 31. The socket connector 33 has an inserting slot (not shown) toward one direction away from the LEDs 32.

Please refer to the above components, the relative position and the relationship of the above components are shown as FIG. 3 (isometric view) and FIG. 3A (planar cutaway view) and explained as follows.

The light emitting unit 3 takes a back surface of the circuit boards 311 to dispose on the mounting surface 211 of the base 2, and the circuit boards 311 are fixed on the base 2 by screws, adhesives, or other suitable means.

The base 2 and the light emitting unit 3 are inserted into the glass tube 1, and the circular arc surface 221 of the connecting portion 22 is adhered to the inner surface of the glass tube 1 by the glue 4 (e.g., silica gel). Preferably, the grooves 222 are filled with the glue 4 in order to increase contact area between the glue 4 and the base 2, so that the base 2 can be securely fixed on the glass tube 1.

The shape of the glue 4 conforms to the glass tube 1 and the base 2. For example, the glue 4 has an elongated shape, the cross-section of the glue 4 is circular arc, and the length of the glue 4 is approximately equal to the length of the glass tube 1. Thus, the heat generated from the LEDs 32 can be directly and uniformly transferred from the base 2 to the glass tube 1 via the glue 4, so that the heat dissipative path can be extended from the base 2 to the glass tube 1.

Specifically, the glue 4 can be disposed on the base 2 through one single application or through several segmental applications. The contour of the glue 4 matches the bottom edge of the base 2 and the inner surface of the glass tube 1. The coverage of the glue 4 on the glass tube 1 is from one end of the glass tube 1 to the opposite end. If the glue 4 is spread on the base 2 through several segmental applications, a gap may be formed between two adjacent portions of glue 4 for providing an extended space to bond with the glass tube 1 later.

The conductive segment 3111 and the grounding segment 3112 of the circuit board module 31 are respectively partially exposed out of two opposite end portions of the glass tube 1. The exposed portion of each conductive segment 3111 and each grounding segment 3112 has two first penetrating holes H1 formed on two opposite sides thereof and penetrating the circuit board module 31 and the mounting portion 21. The exposed portion of each conductive segments 3111 and each grounding segment 3112 has a second penetrating hole H2 formed on the center thereof and penetrating the circuit board module 31, the mounting portion 21, the intermediate portion 23, and the connecting portion 22.

Figure 3:
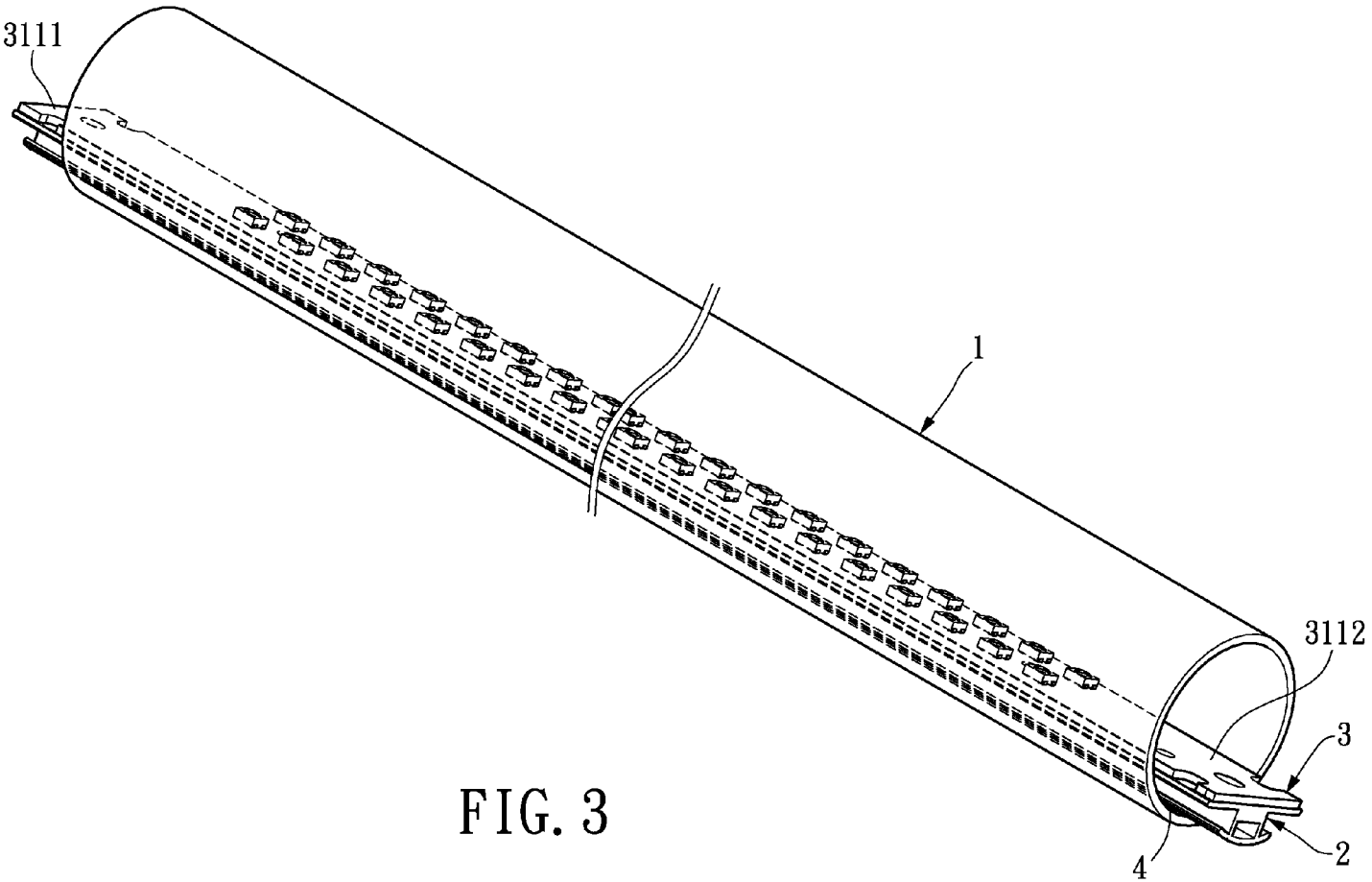
FIG. 3 is a perspective view of the LED tube light without the lateral cover assemblies of the invention.
Figure 3A:
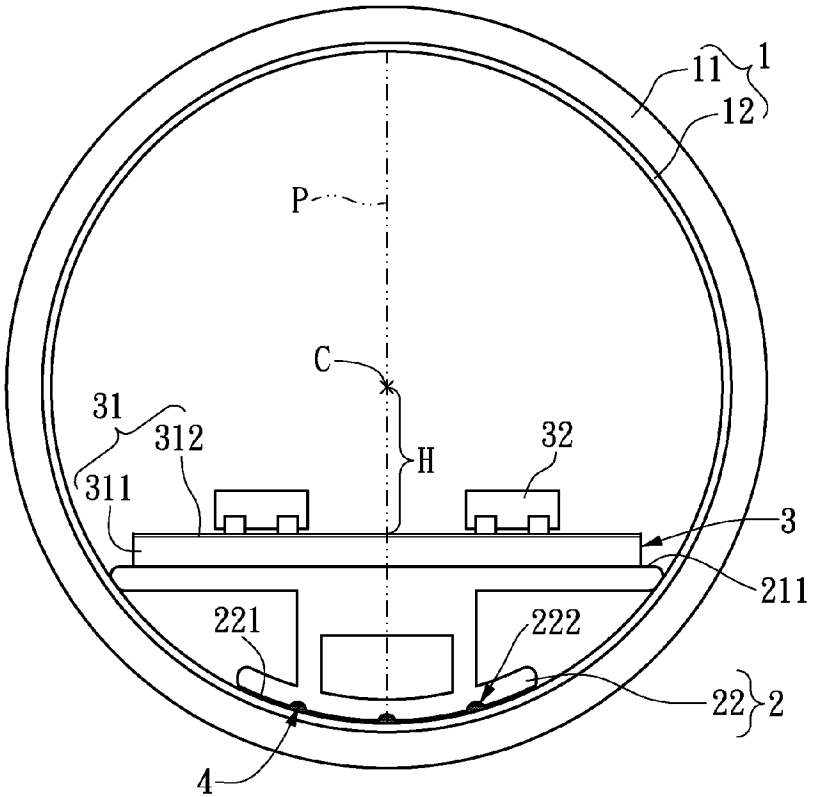
FIG. 3A is a planar section view of FIG. 3.
Figure 3B:
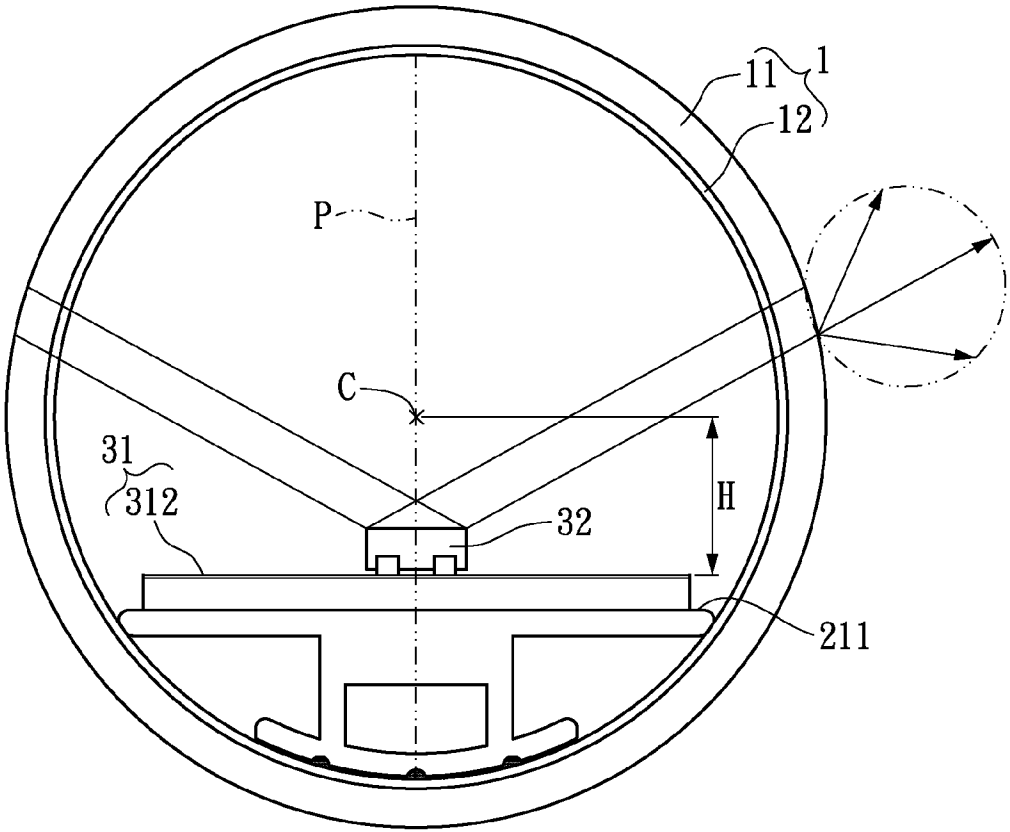
FIG. 3B is a light path view of the LEDs disposed on the center of the circuit board module of the LED tube light of the invention.

Please refer to FIG. 3, which shows the radial cross-section view and a light path of the LEDs 32, when the LEDs 32 disposed on the center of the circuit board module 31.

The bisecting plane P is divided the volume of the base 2 into two identical portions; that is to say, the mounting portion 21, the connecting portion 22, and the intermediate portion 23 are respectively substantially symmetrical to the bisecting plane P. The grooves 222 of the connecting portion 22 are also substantially symmetrical to the bisecting plane P. Moreover, quarter of the radius R is smaller than a shortest distance H between the outer surface of the solder-resistant layer 312 and the central axis C ($H \geq \frac{1}{4} R$). Preferably, the shortest distance H between the outer surface of the solder-resistant layer 312 and the central axis C is smaller than or equal to half of radius R and larger than or equal to one third of radius R ($\frac{1}{2}R \geq H \geq \frac{1}{3}R$).

Figure 3C:
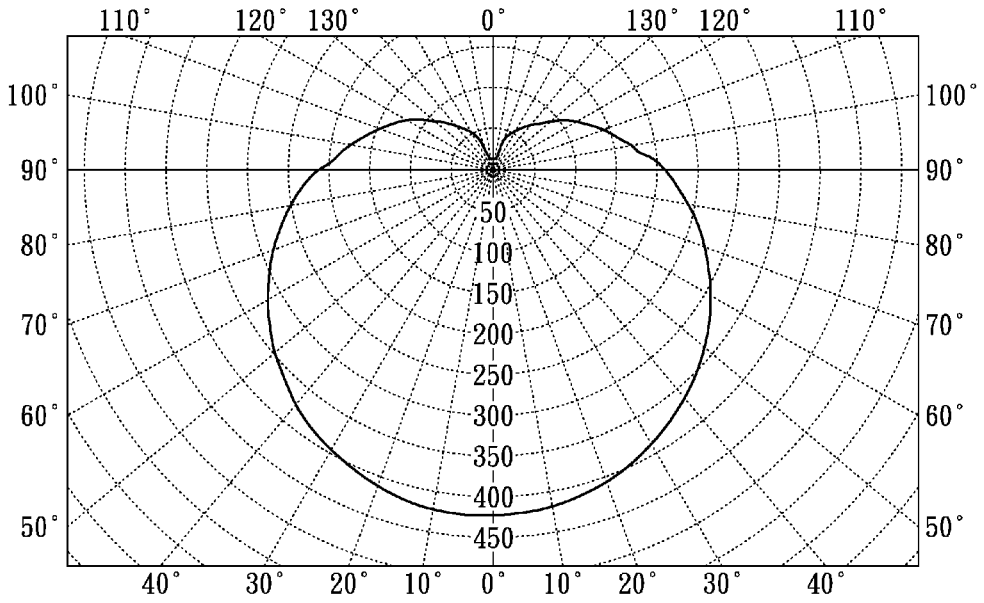
FIG. 3C is a light distribution simulating diagram of the LED tube light of the invention.

The light generated from the LEDs 32 (e.g., the biggest illuminate angle of the LEDs 32 is about 120 degrees) can be emitted to about half area of the inner surface of the glass tube 1 by keeping a distance (slightly smaller than H) between the LEDs 32 and central axis C. Thus, after the light generated from the LEDs 32 passing through the glass tube 1, the glass tube 1 has an illuminate angle about 180 degrees, as shown in FIG. 3C. However, FIG. 3C is based on $H=\frac{1}{3}R$, but not limited thereto.

The shape of the solder-resistant layer 312 is approximately corresponding to the mounting surface 211, that is to say, the width of the solder-resistant layer 312 is almost as the same as the width of the mounting surface 211, so that a space surrounded by the solder-resistant layer 312 and the diffusing layer 12 is defined as a light-mixed room (not labeled).

Thus, the light reflected from the diffusing layer 12 is recycled to the light-mixed room by the solder-resistant layer 312, and then the light is emitted toward the glass tube 1 for increasing the illumination presented by the glass tube 1 (e.g., increasing the light recycling ratio and light-mixed efficiency).

However, if the width of the solder-resistant layer 312 is smaller than the width of the mounting surface 211, the light reflected from the diffusing layer 12 is partially absorbed and scattered by the mounting surface 211, because the mounting surface 211 is not smooth enough to recycle (e.g., reflect) the light.

Figure 3D:
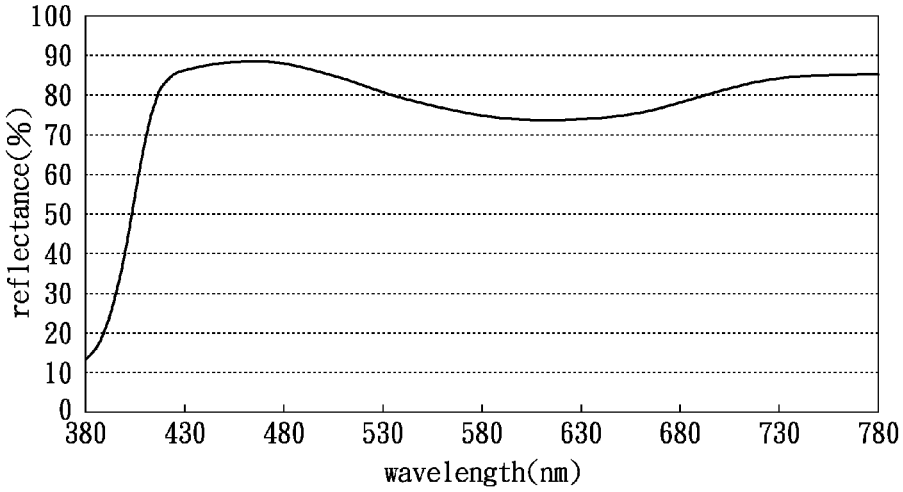
FIG. 3D is a reflectance diagram of the solder-resistant layer under different wavelength light of the LED tube light of the invention.
Figure 3E:
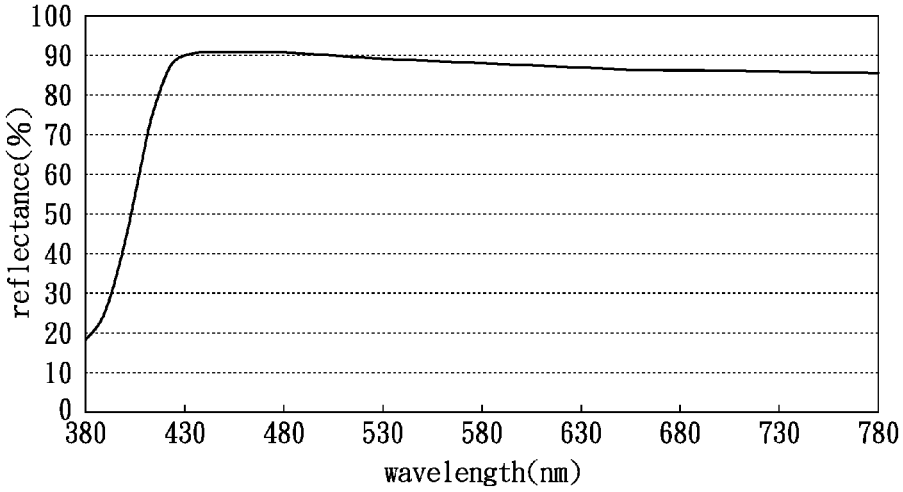
FIG. 3E is a reflectance diagram of the solder-resistant layer made of another material under different wavelength light of the LED tube light of the invention.

Moreover, the solder-resistant layer 312 can be made of materials having optical reflectance as shown in FIG. 3D or 3E. For a light source having light output in the 550 nm wavelength range, the higher the reflectance of the solder-resistant layer 312 with respect to light of 550 nm wavelength, the better the output uniformity and light transmittance can be obtained.

Figure 4A:
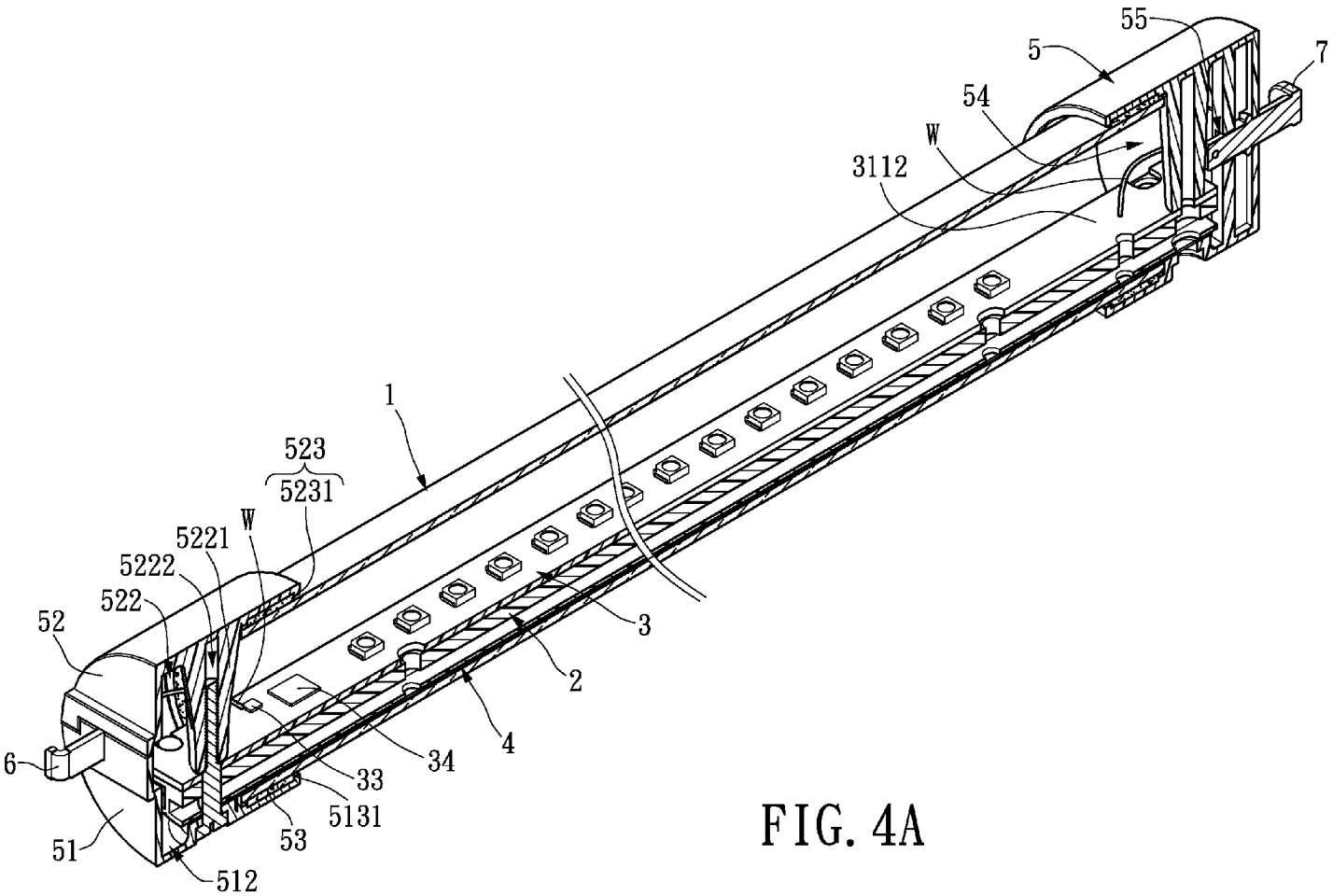
FIG. 4A is an axial section view of the LED tube light of the invention.
Figure 4B:
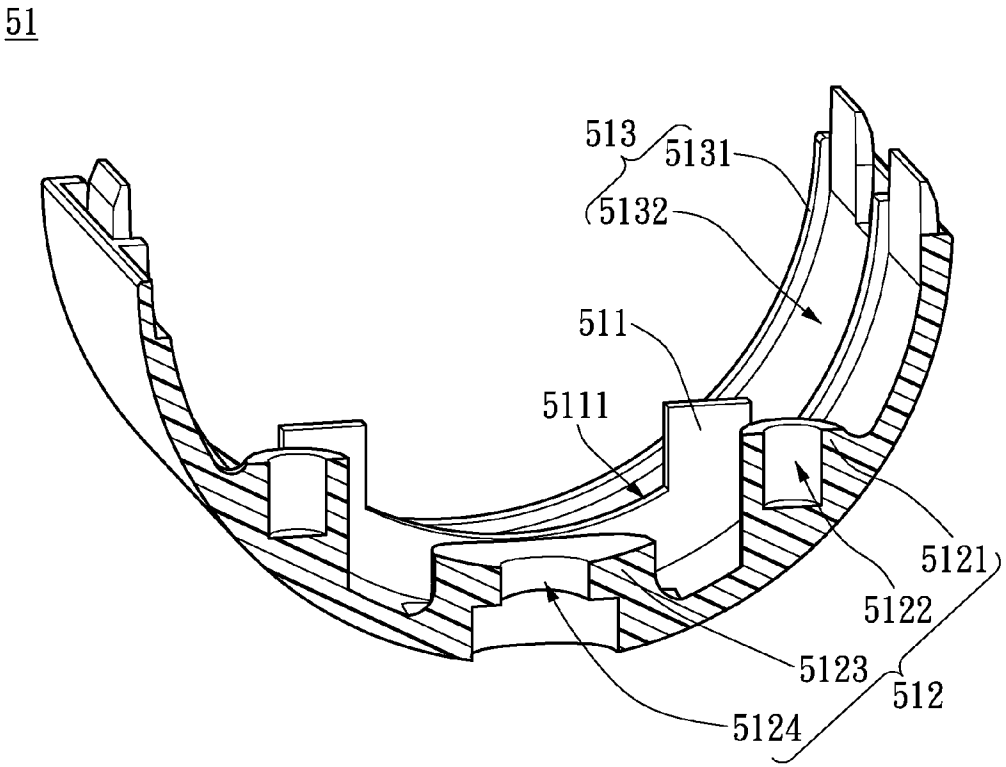
FIG. 4B is a radical section view of the first cover of the LED tube light of the invention.

Please refer to FIG. 2, FIG. 4A (axial cross-section view), and FIG. 4B (radial cross-section view). Each one of the lateral cover assemblies 5 has a first cover 51, a second cover 52, and two buffers 53. The first cover 51 and the second cover 52 of each lateral cover assembly 5 are buckled to each other and defined a cylindrical inserted trough 54 by the inner surfaces thereof. The inserted trough 54 has an internal diameter, which is slightly larger than the diameter of the glass tube 1. Each lateral cover assembly 5 has a terminal-installation structure 55 formed on a portion thereof corresponding to the bottom of the inserted trough 54. The terminal-installation structures 55 of the two lateral cover assemblies 5 are respectively used for installing the conductive terminals 6 and grounding terminal 7. The lateral cover assemblies 5 are approximately identical expect the terminal-installation structures 55 thereof. The following statement takes the lateral cover assembly 5 installed the conductive terminals 6 for example.

The first cover 51 has a stop plate 511 protruding from the inner surface thereof along a radical direction. The stop plate 511 has a positioning notch 5111 concavely formed on a top edge thereof. That is to say, the stop plate 511 has a "U" shape. The first cover 51 defines an installing segment 512 and a buffering segment 513 according to the stop plate 511. The installing segment 512 is adjacent to the terminal-installation structures 55. The installing segment 512 has two first pillars 5121 and a second pillar 5123 arranged in the inserted trough 54. Each first pillar 5121 has a first fixing hole 5122 concavely from the end surface thereof. The second pillar 5123 is arranged between the two first pillars 5121 and between the stop plate 511 and the terminal-installing structure 55. The second pillar 5123 has a second fixing hole 5124 concavely from the end surface thereof, and the end surface of the second pillar 5123 has a circular arc shape.

The first pillar 5121 and the second pillar 5123 are arranged between the "U" shaped stop plate 511 and the bottom of the inserted trough 54.

The second cover 52 has a stop plate 521 protruded from the inner surface thereof along a radical direction. The second cover 521 defines an installing segment 522 and a buffering segment 523 according to the stop plate 521. The stop plates 511, 521 are arranged coplanar. In other words, the installing segments 512, 522 are arranged corresponding to each other and defines an installing space. The buffering segments 513, 523 are arranged corresponding to each other and defines a buffering space.

The buffering segments 513,523 each has two limited rings 5131 protruded along a radical direction, and the two limited rings 5131 are respectively arranged on two edges of each buffering segment 513, 523 away from and adjacent to the terminal-installation structure 55 in order to form an accommodating trough, which is the sign 5132 pointed in FIG. 4B.

Moreover, the installing segment 522 has a positioning pillar 5221 arranged on the center thereof, and the position pillar 5221 has a positioned hole 5222.

The distance between the stop plate 511 and the bottom of the corresponding inserted trough 54 of the first cover 51 is slightly larger than the length of the exposed portion of the conductive segment 3111. The distance between the stop plate 521 and the bottom of the corresponding inserted trough 54 of the second cover 52 is slightly larger than the length of the exposed portion of the grounding segment 3112.

The buffers 53 (e.g., sponge) are sheet-like and respectively disposed in the accommodating troughs of the first and second covers 51, 52, and the thickness of each buffer 53 is slightly higher than the adjacent positioning ring 5131 (or 5231).

The opposite end portions of the installed structure with the glass tube 1, the base 2, the light emitting unit 3, and the glue 4 are respectively disposed in the inserted troughs 54 of the lateral cover assemblies 5. The exposed portions of the base 2 and light emitting unit 3 are arranged in the installing segments 512, 522 of the first and second covers 51, 52.

Moreover, the connecting portion 22 and intermediate portion 23 of the base 2 are disposed in the positioning notch 5111, and the mounting portion 21 and the connecting portion 22 contact the edge of the stop plate 511 of the first cover 51.

The installed portion 21 of the base 2 is abutted on the end surface of each first pillar 5121, and each first penetrating hole H1 is communicated to each first fixing hole 5122. Each first cover 51 is fixed on the base 2 by using a screw (not shown) passing through each first penetrating hole H1 and the corresponding first fixing hole 5122. Besides, in another embodiment (not shown), the first pillar 5121 has a buckling arm protruded from the end surface thereof, and the first cover 51 is fixed on the base 2 by the buckling arm buckled the base 2.

The connecting portion 22 of the base 2 is abutted on the end surface of each second pillar 5123, the solder-resistant layer 312 of the circuit board module 31 is abutted on the end surface of each positioning pillar 5221, and each second penetrating hole H2 is communicated to the corresponding second fixing hole 5124 and the corresponding positioning hole 5222. Each second penetrating hole H2 is respectively communicated to each second fixing hole 5124 and each positioning hole 5222. Each first and second covers 51, 52 are fixed on the base 2 by using a screw (not shown) passing through each second penetrating hole H2, the corresponding second fixing hole 5124, and the corresponding positioning hole 5222.

The two end edges of the glass tube 1 are respectively abutted on the surface of the stop plates 511, 521, which are respectively adjacent to the buffering segments 513, 523. The buffers 53 are surrounded seamlessly abutted on the outer surface of the two end portions of the glass tube 1, so that when the force is transferred from the lateral cover assemblies 5 to the glass tube 1, the force is uniformly dispersed to the outer surface of the two end portions of the glass tube 1.

Thus, the length of the base 2 is larger than the length of the glass tube 1 for providing the lateral cover assemblies 5 to be fixed on the end portions of the base 2 by a fixing means (e.g., screw or buckled). The force is transferred from the lateral cover assemblies 5 to the glass tube 1 via the base 2, so that the force is uniformly dispersed to the glass tube 1 for preventing the glass tube 1 from loading the force directly and reducing the broken possibility of the glass tube 1 resulted from concentrating the force on a specific point.

Figure 4C:
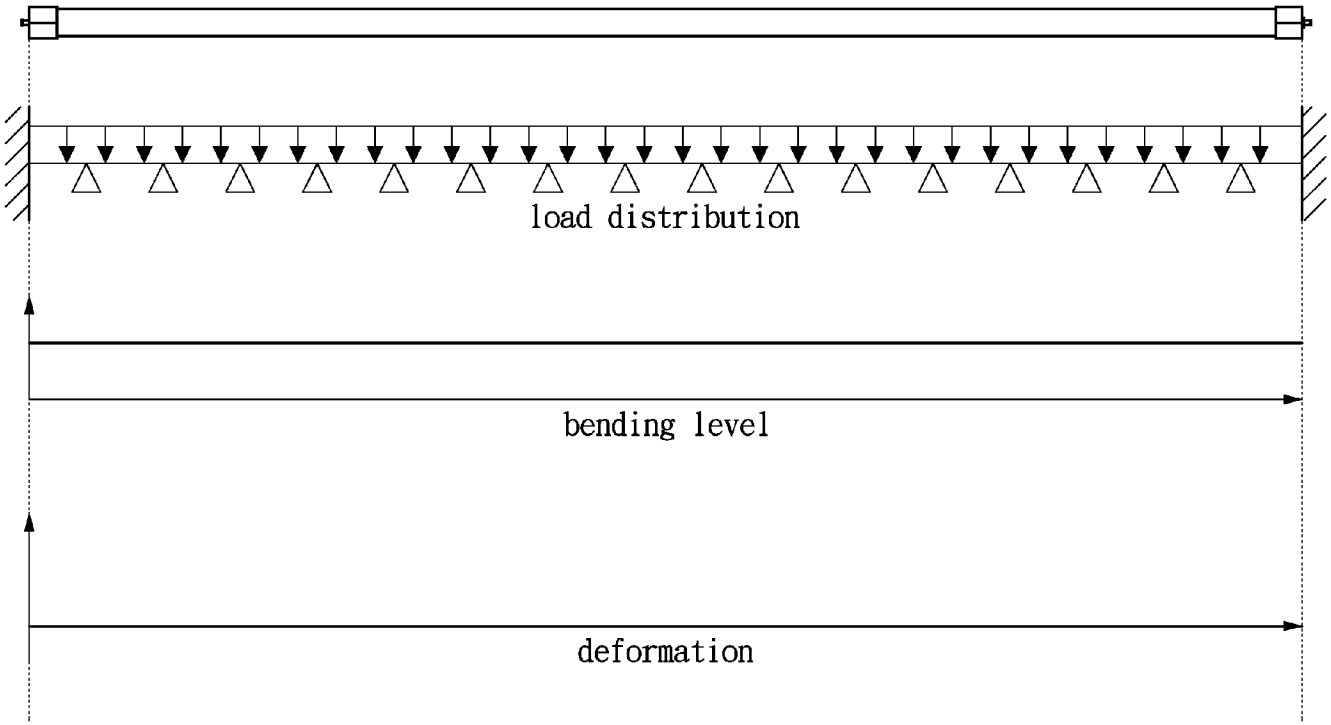
FIG. 4C is a loaded testing diagram of the LED tube light of the invention.

Moreover, when the LED tube light is loaded a force, such as the force is generated from rotating the lateral cover assembly 5 or is the weight of the LED tube light, the force is more uniformly dispersed to the glass tube 1 by fixing the base 2 on the inner surface of the glass tube 1 with the glue 4 for avoiding the glass tube 1 broken resulted from concentrating the force on a specific point (as FIG. 4C shown).

Figure 4D:
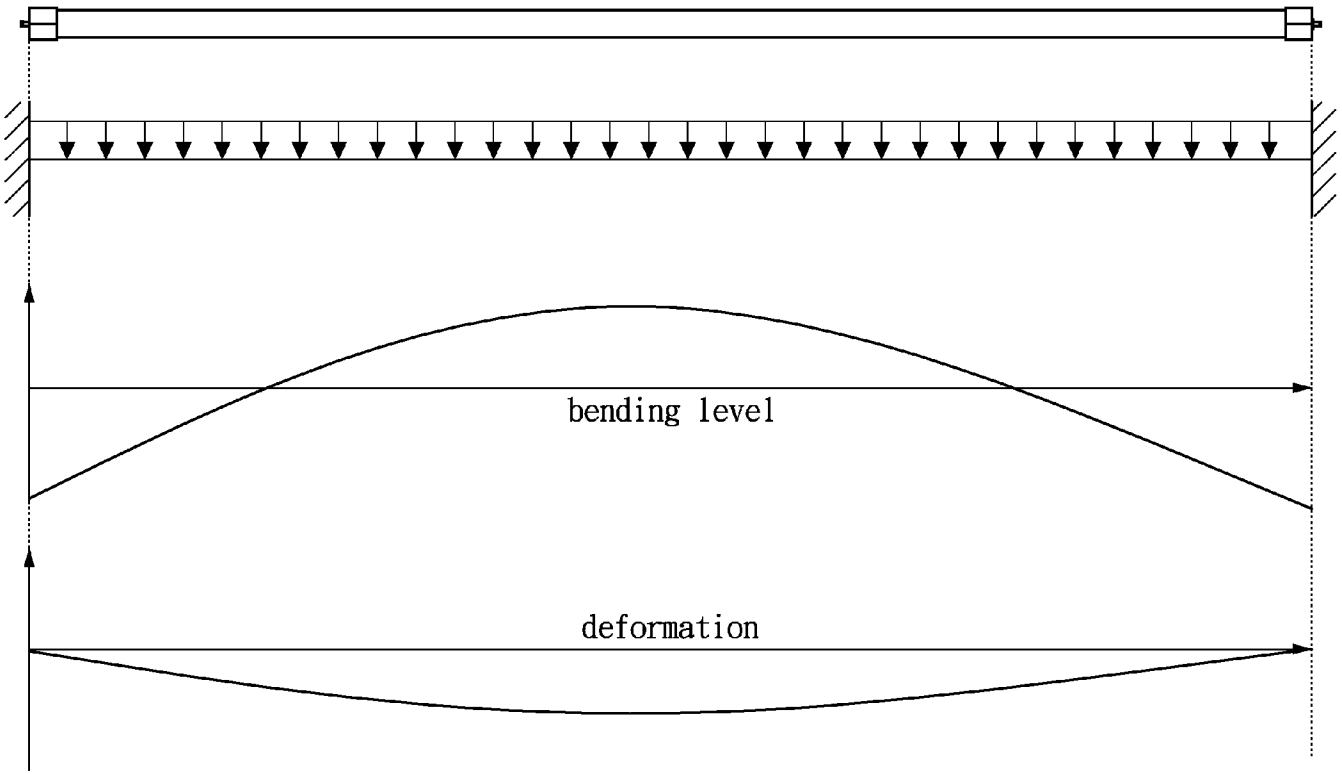
FIG. 4D is a loaded testing diagram of the LED tube light without using the glue of the invention.

Please refer to FIG. 4D, which shows the testing diagram of the LED tube light without using the glue 4. The LED tube light has a deformation phenomenon with slightly bending. However, please refer to FIG. 4C, which shows the relative position of the corresponding components of the LED tube light is maintained by the glue 4, thereby increasing the reliability and reducing the deformation possibility and broken possibility. The data of FIGS. 4C and 4D are calculated by the conventional calculating methods, so that this embodiment does not describe the conventional calculating methods.

One portion of each conductive terminal 6 arranged in the corresponding inserted trough 54 is electrically connected to the socket connector 33 by a wire W for electrically connecting to the light emitting unit 3. One portion of the grounding terminal 7 arranged in the corresponding inserted trough 54 is electrically connected to the grounding segment 3112.

Additionally, the LED tube light as shown in FIG. 1 has a length with 4 ft, a maximum loaded stress with 47.6 MPa, a maximum deformation length with 9.92 mm, and a junction temperature (Tj) with 89.4□, but not limited thereto. Moreover, the invention takes the lateral cover assemblies 5, the conductive terminals 6, and the grounding terminal 7 for example, but in use, a conventional junction can be used to replace.

Figure 5:
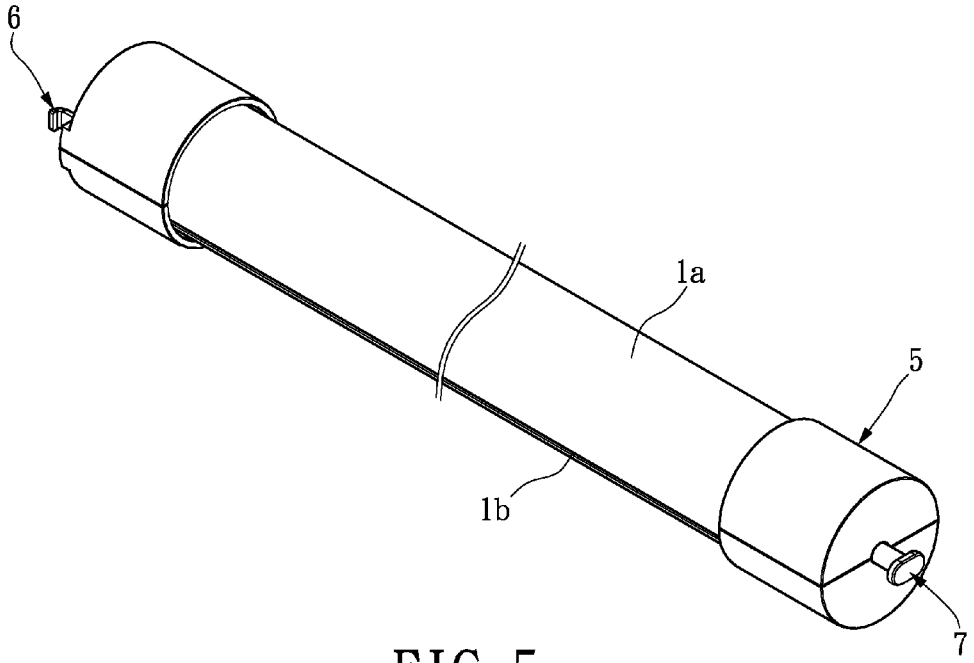
FIG. 5 is a perspective view of another type of the glass tube of the invention.
Figure 5A:
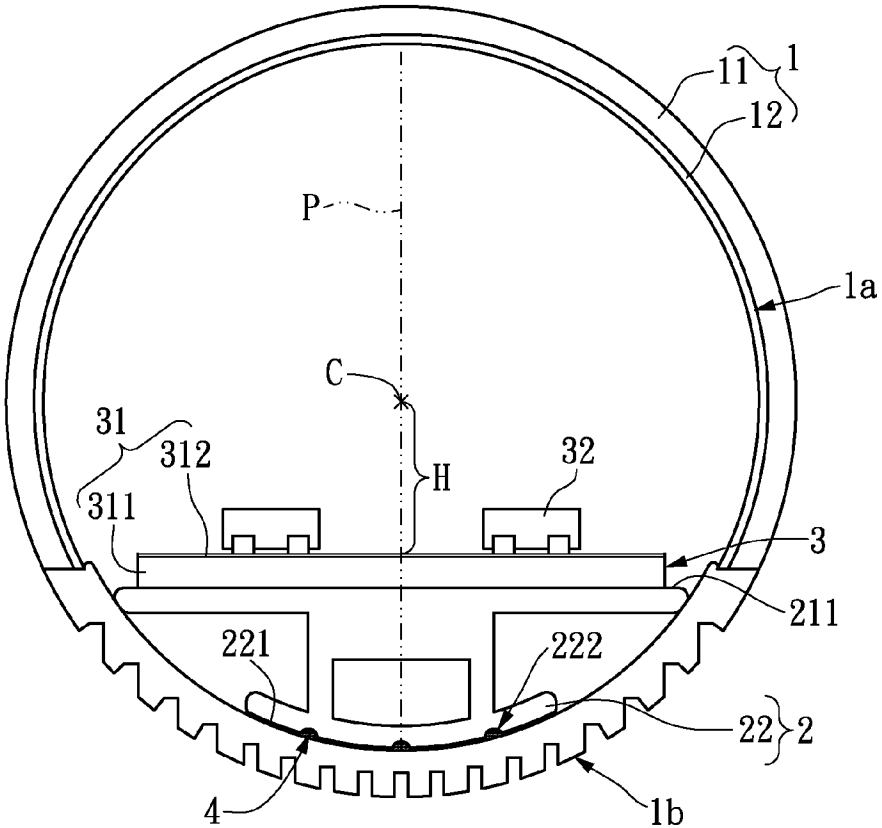
FIG. 5A is a planar section view of FIG. 5.

Expect for the above LED tube light, the glass tube 1 has another types described as follows. The above glass tube 1 takes one piece having a hollow cylinder shape for example, but in use, the glass tube 1 can be a transparent upper segment 1*a* and a nontransparent lower segment 1*b* installed on the upper segment 1*a* (as FIG. 5 shown). Specifically, the upper segment 1*a* and the lower segment 1*b* each has a half hollow circular tube shape, and the inner surface of the lower segment 1*b* is adhered to the circular arc surface 221 of the base 2 by the glue 4 for maintaining the relative position therebetween (as FIG. 5A shown).

The upper segment 1*a* is made of glass, and the lower segment 1*b* is made of high thermal conductive efficiency material, such as metallic material (e.g., aluminum), ceramic material (e.g., alumina or aluminum nitride), or thermal conductive plastic.

Figure 5B:
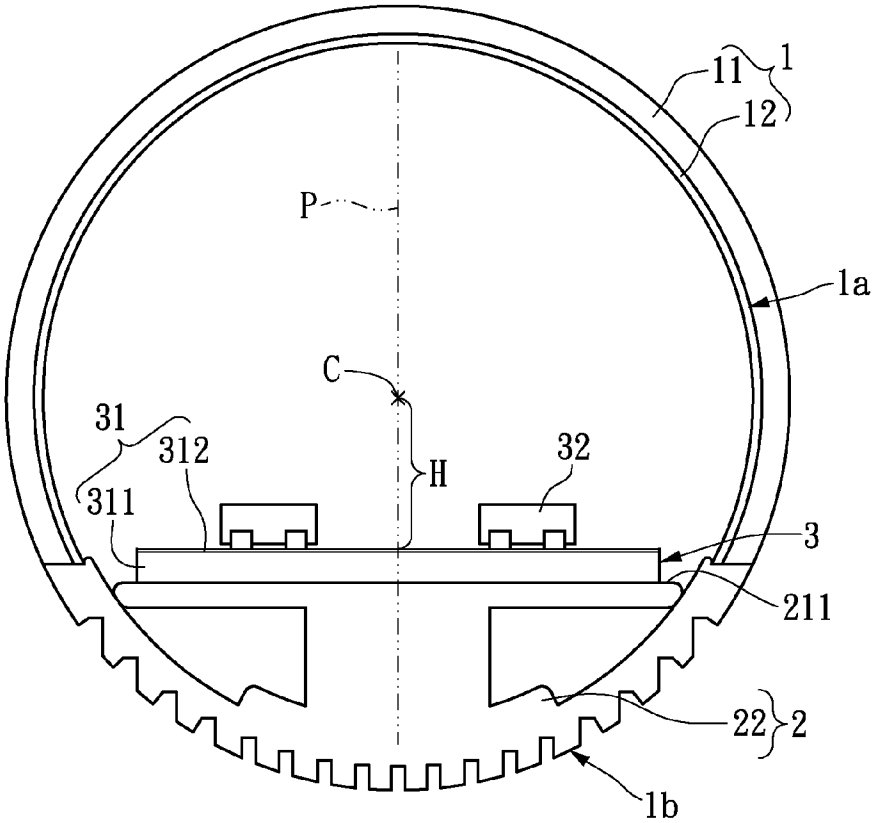
FIG. 5B is another type planar section view of FIG. 5.

Moreover, as shown in FIG. 5B, the base 2 and the lower segment 1*b* can be formed in one piece for omitting the glue 4. The structure of the base 2 and the lower segment 1*b*, the upper segment 1*a*, and the two lateral cover assemblies 5 are matched to each other. Specifically, the upper segment 1*a* has a half hollow circular tube shape, and the structure of the base 2 and the lower segment 1*b* has a substantial half circular tube shape.

The upper segment 1*a* is made of glass, and the structure of the base 2 and the lower segment 1*b* is made of high thermal conductive efficiency material, such as metallic material (e.g., aluminum), ceramic material (e.g., alumina or aluminum nitride), or thermal conductive plastic.

Additionally, as FIGS. 5A and 5B shown, the surface of the lower segment 1*b* contacted to the upper segment 1*a* is arranged between an imagining plane extended from the solder-resistant layer 312 and an imagining plane extended from the mounting surface 211. However, in use, the surface of the lower segment 1*b* contacted to the upper segment 1*a* can be arranged on the imagining plane extended from the solder-resistant layer 312 or the imagining plane extended from the mounting surface 211.

Figure 6:
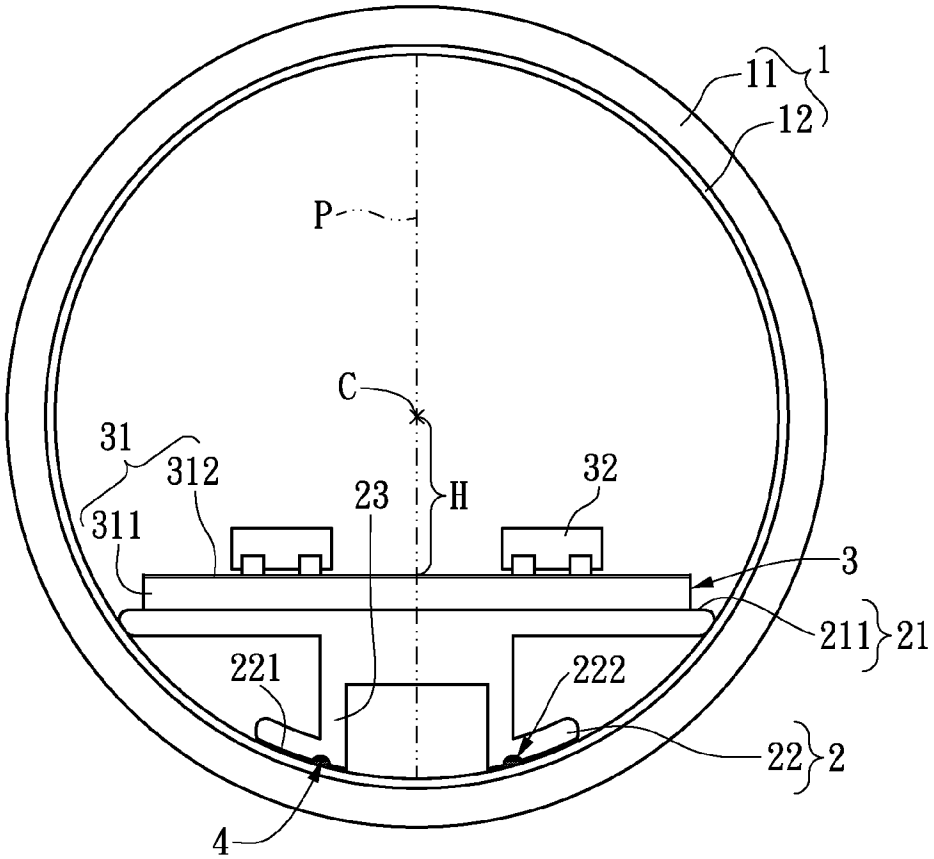
FIG. 6 is a perspective view of another type of the base of the LED tube light of the invention.

The base 2 in this embodiment takes the inverted mound shape for example, but in use, not limited thereto. For example, the cross-section of the base 2 has a "π" shape (as FIG. 6 shown), and the mounting portion 21, the connecting portion 22, and the intermediate portion 23 are symmetrical to the bisecting plane P. Specifically, the intermediate portion 23 has two arms extended from the mounting portion 21, and the intermediate portion 23 further extends to form the connecting portion 22 and the grooves 222 of the connecting portion 22. In other words, the connecting portion 22 is tantamount to the feet of "π".

Based on the above, when the lateral cover assemblies is loaded a force, the force is transferred to the base and then uniformly dispersed to the glass tube by installing (e.g., screw or buckled) the lateral cover assemblies on the base, so that the reliability of the glass tube is improved and the broken probability of the glass tube is reduced. Moreover, an external force can more uniformly dispersed to the glass tube by fixing the base on the inner surface of the glass tube with the glue.

The glue is filled with the grooves in order to increase the contact area between the glue and the base, so that the base is fixed on the glass tube more stable.

The force on the LED tube light is more uniformly dispersed by forming the base and the lower segment in one piece.

When the light emitted from the LEDs passes through the glass tube, the glass tube has an illuminate angle about 180 degrees by keeping a distance (slightly smaller than ⅓ R) between the LEDs and central axis C.

The socket connector and the electronic unit are installed on the circuit boards, so that the LED tube light does not need to prepare an extra circuit board for providing the socket connector and the electronic unit to install.

The descriptions illustrated supra set forth simply the preferred embodiments of the invention; however, the characteristics of the invention are by no means restricted thereto. All changes, alternations, or modifications conveniently considered by those skilled in the art are deemed to be encompassed within the scope of the invention delineated by the following claims.

What is claimed is:

1. An LED tube light, comprising:

a glass tube;

a base having a length larger than the length of the glass tube, wherein two opposite end portions of the base are arranged out of a region defined by orthographically projecting from the glass tube to the base;

a light emitting unit fixed on the base arranged to emit light through the glass tube, wherein the light emitting unit has a circuit board module fixed on the base and a plurality of LEDs mounted on the circuit board module; and two lateral cover assemblies respectively covering two end portions of the glass tube and installed on the two end portions of the base for maintaining relative position between the cover assemblies and the base, wherein each lateral cover assembly has a first cover, a second cover installed on the first cover, and at least one buffer, wherein the first and second covers each defines an installing segment and a buffering segment, and each buffer is disposed on the buffering segments of each of the installed first and second covers, and wherein the two end portions of the glass tube are respectively disposed in the buffering segments of the two lateral cover assemblies, and the outer surface of the two end portions of the glass tube are respectively abutted on the buffers of the two lateral cover assemblies, wherein the installing segment of each first cover has a first pillar and a second pillar, the installing segment of each second cover has a positioning pillar, and wherein the two end portions of the base are respectively abutted on the second pillars of the two lateral cover assemblies, two opposite end portions of the circuit board module disposed above the two end portions of the base are respectively abutted on the positioning pillars of the two lateral cover assemblies.

2. The LED tube light as claimed in claim 1, wherein the light emitting unit is disposed on a surface of the base facing the glass tube, and wherein the glass tube is one piece having a hollow cylinder shape, a transparent upper segment and a nontransparent lower segment installed on the upper segment, or a transparent upper segment and a nontransparent lower segment extended from the base and installed on the upper segment.

3. The LED tube light as claimed in claim 2, further comprising a glue, wherein the glass tube is adhered to the base by the glue for maintaining the relative position between the cover assemblies and the base.

4. The LED tube light as claimed in claim 1, wherein the first pillars of the two lateral cover assemblies are respectively screwed onto the two end portions of the base.

5. The LED tube light as claimed in claim 1, wherein the second pillars and the positioning pillars of the two lateral cover assemblies are respectively screwed to the two end portions of the base and the two end portions of the circuit board module.

6. The LED tube light as claimed in claim 2, wherein the glass tube defines a central axis, and the glass tube is substantially symmetrical to the central axis, the distance between the central axis and the glass tube in the radial cross-section of the glass tube is defined as a radius, and wherein the light emitting unit has a circuit board module fixed on the base and a plurality of LEDs mounted on the circuit board module, and a quarter of the radius is smaller than a shortest distance between the central axis and an outer surface of the circuit board module.

7. The LED tube light as claimed in claim 6, wherein the circuit board module has at least one circuit board fixed on the base and a solder-resistant layer coated on the circuit board for reflecting light, the LEDs are mounted on the circuit board, and wherein a quarter of the radius is smaller than a shortest distance between the outer surface of the solder-resistant layer and the central axis.

8. The LED tube light as claimed in claim 6, further comprising two conductive terminals installed to one of the lateral cover assemblies, wherein the circuit board module has a socket connector and an electronic unit mounted on the circuit board and arranged between the conductive terminals and the LEDs, and wherein the socket connector is electrically connected to the LEDs by the circuit board and the terminals by at least one wire.

9. The LED tube light as claimed in claim 3, wherein the base has at least one groove concavely formed on a surface thereof adhered with the glue, and the groove is filled with the glue.

10. The LED tube light as claimed in claim 2, wherein the length of the glass tube added to one third of the length of the lateral cover assemblies is smaller than the length of the base, and the length of the glass tube added to two thirds of the length of the lateral cover assemblies is larger than the length of the base.

11. The LED tube light as claimed in claim 2, wherein the base has a mounting portion, a connecting portion, and an intermediate portion connected to the mounting portion and the connecting portion, and wherein the light emitting unit is fixed on the mounting portion, the connecting portion is connected to the glass tube.

12. The LED tube light as claimed in claim 11, wherein the width of the connecting portion is larger than or equal to half of the width of the mounting portion and smaller than the width of the mounting portion, or the width of the mounting portion is larger than double the width of the connecting portion and smaller than or equal to three halves the width of the connecting portion.

13. An LED tube light, comprising:

a glass tube;

a base having a length larger than the length of the glass tube, wherein two opposite end portions of the base are arranged out of a region defined by orthographically projecting from the glass tube to the base;

a light emitting unit fixed on the base arranged to emit light through the glass tube; and two lateral cover assemblies respectively covering two end portions of the glass tube and installed on the two end portions of the base for maintaining relative position between the cover assemblies and the base, wherein each lateral cover assembly has a first cover, a second cover installed on the first cover, and at least one buffer, wherein the first and second covers each defines an installing segment and a buffering segment, and each buffer is disposed on the buffering segments of each of the installed first and second covers, and wherein the two end portions of the glass tube are respectively disposed in the buffering segments of the two lateral cover assemblies, and the buffers of the two lateral cover assemblies respectively clip the outer surface of the two end portions of the glass tube.

14. An LED tube light, comprising:

a glass tube;

a base having a length larger than the length of the glass tube, wherein two opposite end portions of the base are arranged out of a region defined by orthographically projecting from the glass tube to the base;

a light emitting unit fixed on the base arranged to emit light through the glass tube; and two lateral cover assemblies respectively covering two end portions of the glass tube and installed on the two end portions of the base for maintaining relative position between the cover assemblies and the base, wherein each lateral cover assembly has a first cover, a second cover installed on the first cover, and at least one buffer, wherein the first and second covers each defines an installing segment and a buffering segment, and each buffer is disposed on the buffering segments of each of the installed first and second covers, and wherein the two end portions of the glass tube are respectively disposed in the buffering segments of the two lateral cover assemblies, and the buffers of the two lateral cover assemblies respectively clip the outer surface of the two end portions of the glass tube, wherein the installing segment of each first cover has a pillar, the installing segment of each second cover has a positioning pillar, and wherein the two end portions of the base are respectively abutted on the pillars of the two lateral cover assemblies, two opposite end portions of the light emitting unit disposed above the two end portions of the base are respectively abutted on the positioning pillars of the two lateral cover assemblies.

* * * * *